United States Patent [19]

Ikeura

[11] Patent Number: 4,545,348

[45] Date of Patent: Oct. 8, 1985

[54] IDLE SPEED CONTROL METHOD AND SYSTEM FOR AN INTERNAL COMBUSTION ENGINE

[75] Inventor: Kenji Ikeura, Yokosuka, Japan

[73] Assignee: Nissan Motor Company, Ltd., Japan

[21] Appl. No.: 506,325

[22] Filed: Jun. 21, 1983

Related U.S. Application Data

[62] Division of Ser. No. 393,081, Jun. 28, 1982, abandoned.

[30] Foreign Application Priority Data

May 22, 1979 [JP] Japan ..... 54-62204
May 25, 1979 [JP] Japan ..... 54-64841

[51] Int. Cl.[4] ..... F02B 3/00; F02D 1/04; F02D 9/02

[52] U.S. Cl. ..... 123/339; 123/585; 123/440; 123/340; 123/588

[58] Field of Search ..... 123/585, 588, 339, 340, 123/440, 563, 486

[56] References Cited

U.S. PATENT DOCUMENTS 3,964,457 6/1976 Coscia ..... 123/340
4,072,137 2/1978 Hattori et al. ..... 123/588
4,108,127 8/1978 Chapin et al. ..... 123/588
4,132,200 1/1979 Asano et al. ..... 123/440
4,214,558 7/1980 Nishioka et al. ..... 123/440
4,289,100 9/1981 Kinugawa et al. ..... 123/585
4,375,208 3/1983 Furuhashi et al. ..... 123/585

*Primary Examiner*—Raymond A. Nelli
*Attorney, Agent, or Firm*—Lowe, King, Price & Becker

[57] ABSTRACT

An intake air flow rate control method and system for an internal combustion engine includes an open loop control strategy carried out during unstable engine driving conditions. During open loop control, a pulse signal applied to an air flow rate control valve means is determined both as a function of open loop ratio and feedback ratio. The duty cycle of the pulse signal for open loop control is varied corresponding to engine coolant temperature as well as engine load condition. Thus, upon switching control operation from open loop control to feedback control, varying of pulse duty cycle to be applied to the valve means occurs smoothly. Further, in open loop control, the control system smoothly follows variations in engine load conditions.

14 Claims, 5 Drawing Figures

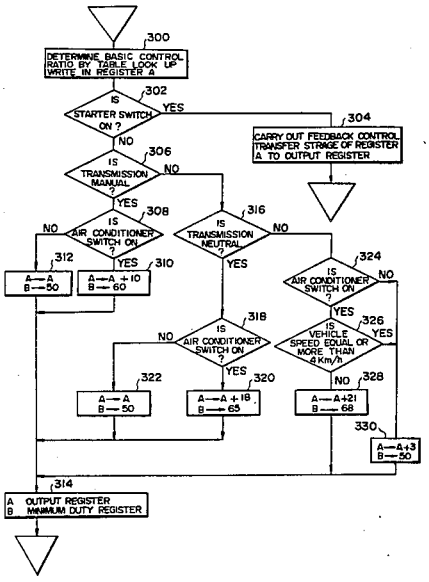

IDLE SPEED CONTROL METHOD AND SYSTEM FOR AN INTERNAL COMBUSTION ENGINE

This is a division of application Ser. No. 393,081 filed 06/28/82, now abandoned.

BACKGROUND OF THE INVENTION

1. Field of the Invention

The present invention relates generally to an intake air flow rate control system for an internal combustion engine of an automotive vehicle. More specifically, the present invention relates to a control strategy for controlling intake air flow rate of the internal combustion in the air flow rate control system wherein either open loop control or closed loop control is selectively carried out and a smooth transition is made between the two.

2. Description of the Prior Art

In recent years, pollution of the atmoshere by nitrogen oxides $NO_x$, carbon monoxide CO, gaseous sulfuric acid and so on produced in the exhaust gas of automotive vehicles has become a serious social problem. In addition to this, the price of fuel, i.e. gasoline or petrol, for automotive vehicles has become higher and higher, because of the limited resources thereof. For preventing atmospheric pollution caused by exhaust gas of vehicles and for fuel economy, current automotive vehicles have been required to control engine operation so that the engine is driven in the most desirable condition even when the vehicle engine is idling.

In the intake air flow rate control system, it is preferable to carry out feedback (closed loop) control or open loop control selectively, according to engine driving condition. In feedback control, a control signal is determined corresponding to an actual engine speed measured by an engine speed sensing means such as crank shaft angle sensor and a reference engine speed determined corresponding to an engine or coolant temperature. It should be noted that, in the present specification, the word "reference engine speed" means a target engine speed theoretically determined based in engine operating parameters. Feedback control is carried out under stable engine driving conditions. Therefore, when the engine is driven unstably, feedback control should not be carried out and the intake air flow rate should be controlled by open loop control.

Therefore, it is required to switch control operation between feedback control and open loop control depending on engine conditions. In the prior art, there have been developed many kinds of switching means for switching between feedback control and open loop control. Generally, by conventional means, when control operation is switched from feedback control to open loop control, the feedback control signal is fixed at the final value immediately before switching occurs. The fixed value is maintained during carrying out of open loop control. Therefore, when control operation returns to feedback control, the first control signal determined by feedback control is the same value as the previously fixed value. If the engine driving condition is substantially changed during carrying out of open loop control, the control signal value of feedback control is quite different from the required value corresponding to the engine driving condition. This will possibly cause unstable control of the air flow rate and sometimes results in engine stall. For example, during warming-up of the engine under cold engine condition, the control signal for determining the duty cycle of a pulse signal to be applied to air flow rate control valve means in order to determine the energized period and deenergized period thereof is relatively high for the purpose of rapidly warming-up of the engine. If the engine is maintained in idling condition, the pulse duty cycle applied to the valve means is gradually reduced corresponding to increasing engine or coolant temperature. However, if the vehicle starts driving immediate after engine starting and thereby, control operation is switched from feedback control to open loop control, the pulse duty cycle determined by feedback control is fixed at a relatively high level. During driving of the vehicle, the engine or coolant is gradually warmed up. When the vehicle is stopped the engine is placed in an idling condition, the reference engine speed based on the engine or coolant temperature becomes relatively low. Thus, control mode switches from open loop control to feedback control, pulse duty cycle determined by feedback control pulse signal applied to the valve means is excessively high to temporarily increase air flow rate and thereby excessively increase engine speed. Although excessively high engine speed will be maintained for a short period of the, it will cause discomfort on the driver. Also, this will temporarily increase harmful components in the exhaust gas.

Further, after starting the engine, even though engine or coolant temperature is the same, loading of the engine varies considerably depending on the engine condition. For example, comparing engine conditions after a relatively long period of idling and immediately after driving at the same temperature, the engine load is different in each condition depending on the difference of friction between movements of internal parts and lubricant oil condition and so on. Generally, the engine load depending on internal friction or lubricant oil condition is gradually reduced and thereby the engine driving condition gradually becomes smooth. On the other hand, the reference engine speed is determined corresponding to the engine or coolant temperature. Therefore, in spite of depending on the engine load condition, the reference engine speed is determined to be the same value both after starting the engine and relatively smooth engine condition. By this, upon starting the engine and when the engine load is substantially high, engine stalling is possible.

SUMMARY OF THE INVENTION

Therefore, it is an object of the present invention to provide an air flow rate control method and system having a means for smoothly switching between feedback control and open loop control corresponding to engine driving condition.

Another object of the present invention is to provide a control strategy in an air flow rate control system for an internal combustion engine, wherein the open loop control system permits varying of feedback control value during carrying out of open loop control.

A further object of the present invention is to provide an air flow rate control method and system including correcting a reference engine speed corresponding to engine load condition.

To achieve the above-mentioned and other objects of the present invention, there is provided an intake air flow rate control method and system within open loop control is carried out during unstable engine driving conditions. During open loop control, the duty cycle of the pulse signal applied to an air flow rate control valve means is determined both by an open loop signal and a feedback signal. The pulse duty cycle for open loop control is varied corresponding to engine or coolant temperature.

Thus, in the present invention, upon switching control operation from open loop control to feedback control, pulse duty to be applied to the valve means is smoothly switched to a feedback signal so as to smoothly switch control operation.

According to another embodiment of the present invention, the air flow rate control method and system include correcting a pulse duty applied to the valve means corresponding to engine load condition determined by kind of transmission, i.e., manual or automatic whether the transmission is in a neutral gear position and whether an air conditioner is turned on and so on. Therefore, the control method and system according to the present invention can follow the engine load condition so as to adapt engine speed to that required depending on the engine load condition.

BRIEF DESCRIPTION OF THE DRAWINGS

The present invention will become more fully understood from the detailed description given below, and from accompanying drawings of the preferred embodiment of the present invention, which, however, are not to be taken as limitative of the present invention in any way, but are for the purpose of elucidation and explanation only.

In the drawings.

DESCRIPTION OF THE PREFERRED EMBODIMENT

Figure 1:
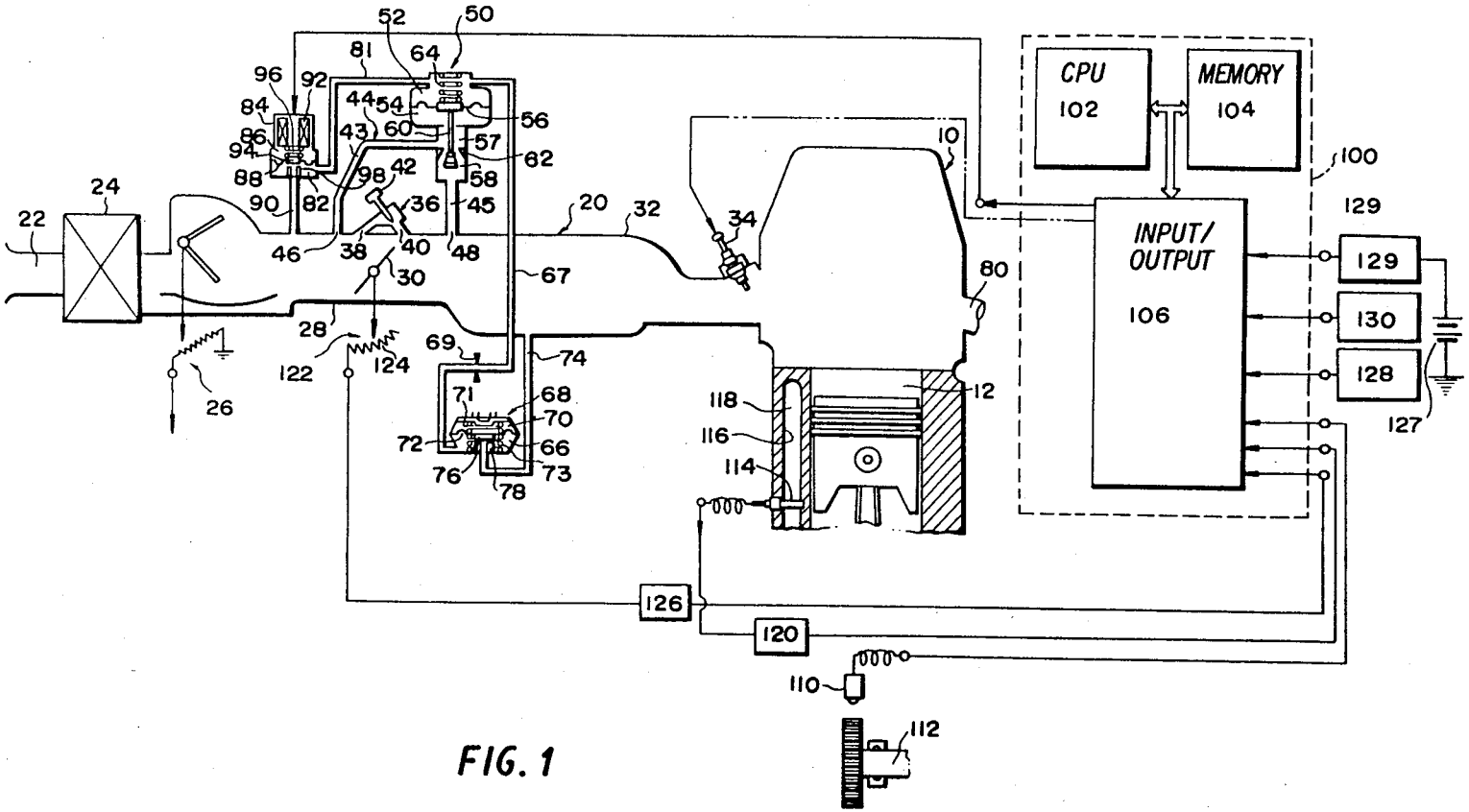
FIG. 1 is a diagrammatical view of an intake air flow rate control system for an internal combustion engine according to preferred embodiment of a the present invention.

Referring now to the drawings, and particularly to FIG. 1, there is illustrated and shown the general construction of an internal combustion engine having a computer controlled fuel injection system, to be provided on an automotive vehicle the air flow rate control system according to the present invention is shown as applied to this internal combustion engine, as an example and for the purposes of explanation only, and should not be taken as limitative of the scope of the present invention. Before moving onto the detailed description, it should be appreciated that the air flow rate control system according to the present invention will be applicable to any type of internal combustion engine which can be controlled by a microcomputer mounted on the vehicle.

In FIG. 1, each of the engine cylinders 12 of an internal combustion engine 10 communicates with an air intake passage generally designated by 20. The air intake passage 20 comprises an air intake duct 22 with an air cleaner 24 for cleaning atmospheric air, and an air flow meter 26 is provided downstream of the air intake duct 22 to measure the amount of intake air flowing therethrough. A throttle chamber 28 in which is disposed a throttle valve 30 is cooperatively coupled with an accelerator pedal (not shown), so as to adjust the flow rate of intake air flowing therethrough, and an intake manifold 32 has a plurality of branches not clearly shown in FIG. 1. Although not clearly illustrated in FIG. 1, the air flow meter is incorporated with another engine control system which determines fuel injection rate, for example. A fuel injector 34 is provided on the intake manifold 32. The rate of injection of fuel through the fuel injector 34 is controlled by an adjusting member, such as, an electromagnetic actuator (not shown). The adjusting member is electrically operated by the other control system which determines fuel injection rate, fuel injection timing and so on corresponding to engine condition sensed by various engine parameter sensing means. It should be noted that, although the fuel injector 34 is disposed on the intake manifold 32 in the shown embodiment, it it possible to locate it in the combustion chamber 12 in a per se well known manner.

An idle port passage 36 is provided opening into the throttle chamber 28. One end port 38 of the idle port passage 36 opens upstream of the throttle valve 30, and the other end port 40 opens downstream of the throttle valve 30, so that the idle port passage 36 bypasses the throttle valve 30. An idle adjusting screw 42 is provided in the idle port passage 36. The idle adjusting screw 42 is manually operable so as to initially adjust the flow rate of intake air flowing through the idle port passage 36. A bypass passage 44 is also provided to the intake air passage 20. One end 46 of the bypass passage 44 opens between the air flow meter 26 and the throttle valve 30 and the other end 48 opens downstream of the throttle valve 30, adjacent the intake manifold 32. Thus the bypass passage 44 bypasses the throttle valve 30 and connects upstream part of the throttle valve 30 to the intake manifold 32. An idle control valve, generally designated by 50, is provided in the bypass passage 44. The idle control valve 50 generally comprises two chambers 52 and 54 separated by a diaphragm 56. The chamber 54 communicates with the atmosphere. The bypass passage 44 is thus separated by the valve means 50 into two portions 43 and 45 respectively located upstream and downstream of the port 57 of the valve 50. The valve means 50 includes a poppet valve 58 disposed within the portion 57 in a manner such that it is movable between two positions, one being opening the valve to establish communication between the portions 43 and 45 of the passage 44 and the other being closing the same. The poppet valve element 58 has a stem 60 whose end is secured to the diaphragm 56 so as to cooperatively move therewith. The diaphragm 56 is biased downwards in the drawing, so as to release the valve element 58 from a valve seat 62, by a helical compression coil spring 64 disposed within the chamber 52 of the valve means 50. Thereby, the valve 50 is normally opened, and normally communicates the portions 43 and 45 of the bypass passage 44 to one another, via its valve port 57.

The chamber 52 of the idle control valve 50 communicates with one chamber 66 of a pressure regulating valve 68 as the constant vacuum source through a vacuum passage 67. The pressure regulating valve 68 is separated into two chambers 66 and 70 by a diaphragm 72. The chamber 66 of the pressure regulating valve 68 is also communicated with the intake manifold 32, so as to introduce vacuum from the intake manifold 32 thereinto, through a passage 74. The chamber 70 is open to the atmosphere in a per se well known manner. To the diaphragm 72 is secured a valve member 76 which is opposed to a valve seat 78 provided at the end of the passage 74. In the chambers 66 and 70 there are respectively disposed helical compression coil springs 71 and 73. The springs 71 and 73 are generally of equal spring pressure in a position in which the diaphragm 72 is in neutral position. It will be noted that, although not shown, the chamber 66 can also be connected with an exhaust-gas recirculation (EGR) control valve which recirculates a part of the exhaust gases flowing through an exhaust passage 80 to the intake manifold 32.

The diaphragm 72 is moved upwards or downwards by change of the balance of the vacuum in the chamber 66 and the atmospheric pressure introduced into the chamber 70. By this moving of the diaphragm 72, the valve member 76 is moved toward or away from the valve seat 78, so as to regulate a reference vacuum for the idle control valve 50. The reference vacuum regulated in the pressure regurating valve means 68 is introduced to the chamber 52 of the idle adjusting valve means 50 through the vacuum passage 67 with an orifice 69. The orifice 69 restricts varying of vacuum flowing into the chamber 52 so as to make smooth the valve operation.

The chamber 52 of the idle control valve 50 is further communicated with a chamber 82 of an intake air valve 84 through an air passage 81. The intake air valve means 84 is divided into two chambers 82 and 86 by a diaphragm 88. The chamber 82 is also communicated with the air intake passage 20 upstream of the throttle valve 30 through a passage 90. An electromagnetic actuator 92 is disposed within the chamber 86 and is electrically operated in response to a train of pulse signals generated based on a control signal from the control signal generator in a hereinafter described control unit in use with a microcomputer. On the diaphragm 88 is provided a valve member 94 which is electromagnetically moved by the actuator 92. In practice, by varying the width, i.e. the pulse duty cycle of the pulse signal based on the control signal, the ratio of the energized period and deenergized period of the actuator 92 is varied. Therefore the ratio of the opening period and the closing period of the valve 94 is varied so as to control the flow rate of the air flowing through the intake air valve 84. In the chamber 86 is further provided a helical compression coil spring 96 which biases the diaphragm together with the valve member 94 toward the end of the passage 90, so as to seat the valve member 94 onto a valve seat 98 provided at the end of the passage 90. By the vacuum from the pressure regulating valve 68, the diaphragm 56 together with the valve element 58 are moved to control the flow of air through the bypass passage 44. The vacuum in the chamber 52 is controlled by controlling the flow rate of the air flowing through the intake air valve 84 and the air passage 81.

When the internal combustion engine 10 is in idling condition, the throttle valve 30 is generally closed so as to restrict the flow of intake air therethrough. Therefore, during idling condition of the internal combustion engine 10, the intake air substantially flows through both the idle port passage 36 and the bypass passage 44, which bypasses the throttle valve 30 and connects the upstream and the downstream portions of the throttle valve 30. Air flow rate through the idle port passage 36 is adjusted by the idle adjusting screw 42, and the air flow rate through the bypass passage 44 is generally controlled by the idle control valve 50. The idle control valve 50 is operated by vacuum fed from the intake manifold 32 through the passage 74, the pressure regulating valve 68, and the vacuum passage 67. The vacuum in the chamber 52 is adjusted by the atmospheric intake air flowing thereinto through the passage 90, the electromagnetic valve 84 and the passage 81. The valve element 58 is operated to control the air flow rate flowing through the passage 44 by the vacuum within the chamber 52. Since the engine speed depends on the intake air flow rate, it can thus be controlled by controlling the air flow through the idle port passage 36 and the bypass passage 44 when the internal combustion engine 10 is in idling condition.

The control operation for adjusting the intake air flow rate performed by controlling the electromagnetic actuator 92 is described hereinafter. The controlling of air flow rate, and thus the control of engine speed during idling condition of the internal combustion engine 10, can also be carried out by adjusting the idle adjusting screw 42. The idle adjusting screw 42 is controlled manually so as to set initial engine idling speed.

Now, returning to FIG. 1, a microcomputer 100, employed for automatically controlling the air flow rate, comprises generally a central processing unit (CPU) 102, a memory unit 104, and an input/output unit 106 i.e. an interface. As inputs of the microcomputer 100, there are various sensor signals, such as:

- a crank pulse and a crank standard pulse, the crank pulse being generated at every one degree or certain degree more than one of the crank angle, and the crank standard pulse being generated at every given crank standard angle by a crank angle sensor 110 detecting the amount of rotation of a crank shaft 112; the crank pulse and the crank standard pulse are applied as an input indicating engine speed and engine crank position;
- a coolant temperature signal, produced by a temperature sensor 114 which is inserted into a coolant passage 116 provided around the engine cylinder 12, and exposed to the coolant 118; the temperature sensor 114 generates an analog signal in response to the coolant temperature and feeds this signal to the input/output unit 106 through an analog-digital converter (A/D converter) 120, in which the coolant temperature signal is converted into a digital code, i.e. a binary number signal, which is suitable as an input for the microcomputer;
- a throttle valve angle signal, derived from an analog signal produced by a throttle valve angle sensor 122 which comprises a variable resistor 124 and converted into digital code by an A/D converter 126;
- a signal from a transmission neutral switch 128, which is applied in the form of an ON/OFF signal;
- a vehicle speed signal, fed from a vehicle speed sensor 130, which is an ON/OFF signal which becomes ON when the vehicle speed is lower than a given speed, e.g., 8 kmh, and is OFF otherwise;
- and a battery voltage signal, fed from the battery 127 through the A/D converter 129.

It will be appreciated that, although, in the shown embodiment, there is employed a variable resistor 124 in the throttle valve angle sensor 122 for detecting the closed position of the throttle valve, an ON/OFF switch could substitute for the variable registor 124, which could become ON when the throttle valve 30 is in the closed position.

Figure 2:
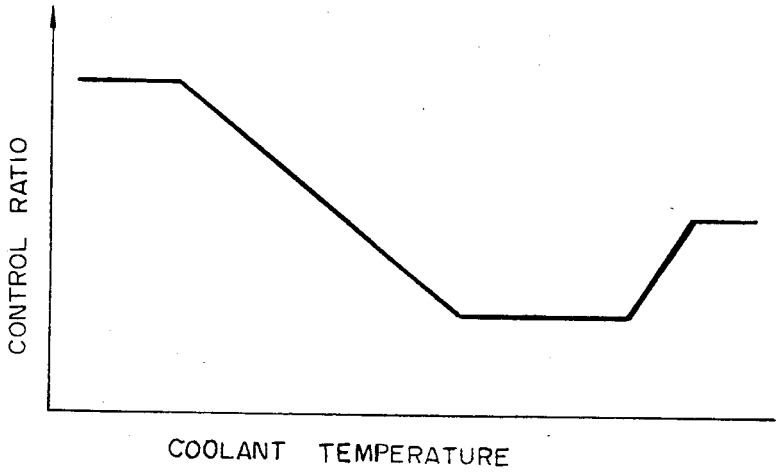
FIG. 2 is a graph showing temperature characteristics of a control signal.

FIG. 2 shows a relationship between the coolant temperature T and the reference engine speed $N_{SET}$, as an example of control characteristics, under the condition of the open-loop control, according to the present invention. The reference engine speed $N_{SET}$ is the desirable engine speed corresponding to the coolant temperature. The duty cycle of the pulse signal applied to the actuator 92 is determined based on the control signal which corresponds to the reference engine speed $N_{SET}$ in open-loop control. Although the control characteristics according to the present invention are described hereafter with respect to an example using the coolant temperature as a control parameter to determine the desired reference engine speed $N_{SET}$, it will be possible to use other factors as the control parameter. For example, engine temperature can also be used as the control parameter for determining the reference engine speed $N_{SET}$.

As shown in FIG. 2, according to the present invention, in a normal driving condition in which the coolant is warmed-up to 60° C. to 95° C., the idling engine speed is maintained at 600 r.p.m. When the coolant temperature is higher than the abovementioned normal range and is thereby over-heated, the reference idling engine speed is increased to the maximum 1400 r.p.m. so as to increase coolant velocity and to increase the amount of cooling air passing a radiator (not shown) for effectively cooling the internal combustion engine. On the other hand, if the coolant temperature is lower than that of the normal range, the reference idling speed is also increased to the maximum 1600 r.p.m. so as to warm-up the engine rapidly and to stabilize idling engine speed in the cold engine condition. One of the most important concepts of the present invention is to specify the reference engine speed at a specific cold temperature of the coolant. According to the present invention, the specific temperature range is 0° C. to 30° C. and the specific reference engine speed in the specific temperature range is 1400 r.p.m. The specific reference engine speed is kept constant within the above-mentioned specific temperature range. The reason for specifying the coolant temperature range and constant engine speed within this range is that, except in extraordinarily cold weather, the coolant temperature is normally in this range when the engine is first started.

In practical control operation with a microcomputer, the reference engine speed is determined in either of two ways; i.e., open-loop control and feedback control. In the feedback control, the pulse duty cycle (the ratio of the pulse width to one pulse cycle) of the pulse signal to be fed back to the electro-magnetic valve means 84 is determined based on the control signal which does not correspond to the reference engine speed $N_{SET}$ as in open-loop control and determined according to the difference between the actual engine speed and the reference engine speed. The feedback control is carried out according to the position of the throttle valve detected or measured by the throttle valve angle sensor 122, the position of the transmission detected by the neutral switch 128, the vehicle speed detected by the vehicle speed switch sensor 130 and so on. In any case, the feedback control to be carried out will be determined with reference to vehicle driving conditions which will be preset in the microcomputer, for example the condition in which the throttle valve is closed and the transmission is in neutral position or the condition in which the throttle valve is closed and the vehicle speed is below 8 km/h. When the vehicle driving condition is not adapted to carry out feedback control, then the microcomputer performs open loop control by table look-up. In open loop control, the reference engine speed $N_{SET}$, i.e. the control signal, is determined with reference to the coolant temperature by table look-up. As apparent from the above, the control signal is the signal which determines the duty cycle of the pulse signal.

The table data is stored in the ROM of the memory unit 104. The table data is looked-up according to the coolant temperature. The following table shows the relationship between the coolant temperature (TW) and corresponding reference engine speed $N_{SET}$, when the table is preset in 32 bytes of ROM.

TABLE

| Coolant temperature TW (°C.) | Reference engine speed $N_{SET}$ (rpm) | Coolant temperature TW | Reference engine speed $N_{SET}$ |
|---|---|---|---|
| 117 and over | 1400 | 36.5 | 1225 |
| 104 | 1000 | 33 | 1325 |
| 94 | 600 | 29.5 | 1400 |
| 80 | 600 | 22 | 1400 |
| 59.5 | 600 | 10 | 1400 |
| 55.5 | 725 | 1 | 1400 |
| 51.5 | 837.5 | −4 | 1425 |
| 47.5 | 937.5 | 10.5 | 1475 |
| 43.5 | 1012.5 | 18.5 | 1525 |
| 40.5 | 1100 | −30 and less | 1600 |

It should be appreciated that in the example shown, the engine speed is increased in steps of 12.5 r.p.m. If the coolant temperature is intermediate between two given values, the reference engine speed $N_{SET}$ will be determined by interpolation.

In open loop control, the duty cycle of the pulse signal for controlling ratio of energized period and deenergized period of the actuator 92 is determined corresponding to the coolant temperature. On the other hand, in feedback control, the control ratio is determined corresponding to actual engine speed determined based on crank angle sensor signal and difference between the actual engine speed and the reference engine speed.

According to the present invention, in open loop control, the control ratio is determined by open loop control ratio and feedback control ratio.

In open loop control, there are three different ways for amending the control ratio corresponding to the coolant temperature, viz., (1) amended total value of the control value corresponding to the coolant temperature;
(2) amending the value depending only on open loop control and not on feedback control; and
(3) in the second method, the value depending on the feedback control is also amended, wherein under open loop control, the value depending on the feedback control is amended corresponding to the coolant temperature.

In the first method, table data determined and preset according to a control characteristics as shown in FIG. 2 is read from the memory unit 104. In practice, the table data is stored in a read-only memory (ROM) included in the memory unit. Corresponding to the coolant temperature sensor signal which is inputted to the microcomputer 100 through the analog/digital convertor 120, the table data is looked up to determine the control ratio.

Figure 3:
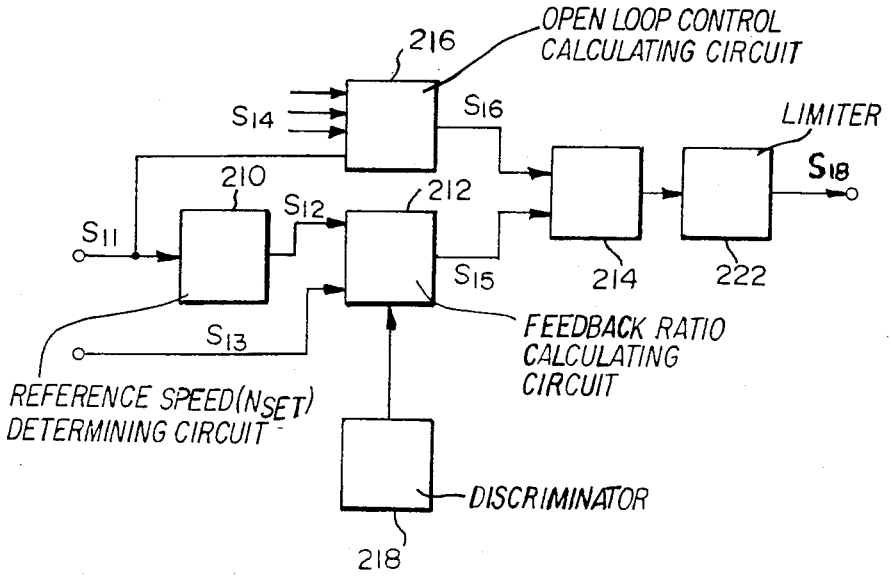
FIG. 3 is a block diagram of an open loop control system according to preferred embodiment of a the present invention.

FIG. 3 shows a block diagram of a device for performing the second method. From the coolant temperature sensor 114, temperature signal $S_{11}$ is applied to a circuit 210 for determining the reference engine speed $N_{SET}$ corresponding to the coolant temperature. The circuit 210 outputs a signal $S_{12}$ indicative of the reference engine speed $N_{SET}$ to a circuit 212 for calculating feedback control ratio. To the circuit 212 is applied the crank pulse signal $S_{13}$ indicative of actual engine speed $N_{RPM}$, fed from the crank angle sensor 110. In the circuit 212, the reference engine speed $N_{SET}$ and the actual engine speed $N_{RPM}$ are compared to determine the difference $\Delta N$ therebetween. The circuit 212 outputs a feedback control signal $S_{15}$ indicative of the feedback control ratio corresponding to the difference $\Delta N$ to an adder 214. The coolant temperature sensor signal $S_{11}$ is also applied to a circuit 216 for calculating open loop control ratio. To the circuit 216 is also applied a correction signal $S_{14}$ such as an acceleration signal and a deceleration signal. The circuit 216 processes the data contained in the inputs to determine the open loop control ratio. A signal $S_{16}$ indicative of the open loop control ratio is transmitted to the adder 214 from the circuit 216. In the adder 214, the control ratio of both of the signals $S_{15}$ and $S_{16}$ are added. The sum of the control ratio of the signals $S_{15}$ and $S_{16}$ is limited at a given maximum and minimum ratio at a circuit 218.

To the feedback control ratio calculating circuit 212 is applied an instruction signal $S_{18}$ fed from a discriminator 222. The discriminator 222 processes various inputs indicative of engine condition to decide whether feedback control is to be carried out. When that discriminator 222 decides the open loop control being to be carried out, the instruction signal $S_{18}$ latches the signal generated at the circuit 212. During generation of signal $S_{18}$, the control ratio calculated in the circuit 212 is maintained at a given fixed ratio. When the open loop control is carried out, the open loop control calculating circuit 216 maintains operation for determining the control ratio to generate the signal $S_{16}$ corresponding to the coolant temperature. Therefore, even though the feedback control ratio is fixed at a given rate during open loop control, switching of the control operation from open loop control to feedback control is performed smoothly so as not to cause delay of response which otherwise possibly causes generating an exessively high or low control ratio.

It will be appreciated that the above-mentioned circuit is included in the microcomputer and operation of the circuits will be carried out therein. Further, although not described in detail, the third method involves is correspondence of the feedback control ratio to the coolant temperature. At this time, the feedback control ratio is varied independently from the difference between the actual engine speed $N_{RPM}$ and the reference engine speed $N_{SET}$.

As above-mentioned, with open loop control and feedback control alternatively carried out, idle engine speed can be accurately and successfully controlled even when the vehicle is driven under cold engine condition without warming up, by correlating at least the open loop control ratio to the coolant temperature according to engine operating characteristics. As shown in FIG. 2, idle control valve means follows the engine condition and is prevented from becoming excessively high or low upon entering idling position. As shown in FIG. 2, the control ratio is relatively high follows high temperature range to increase the idle engine speed to increase coolant velocity through the coolant chamber and also to increase the speed of revolution of the radiator fan to increase the amount of radiating air so as to cool the engine temperature effectively.

After starting the engine, engine conditions are different from those after a relatively long idle driving. even if the coolant temperature is the same. This will depend on differences in lubricant oil condition, friction of each element of engine and so on. For example, comparing the engine conditions warmed up to 20° C. from a substantially long idling engine condition and starting the engine at the same coolant temperature, engine load increases. Further, upon starting the engine, the engine temperature is varied in the various portions thereof and does not always correspond to the coolant temperature. Actually, immediate after starting the engine, portions of engine cylinder adjacent to the combustion chambers are heated faster than the remainder. On the other hand, as mentioned above, since the reference engine speed $N_{SET}$ is determined corresponding to the coolant temperature, the determined reference engine speed upon starting at a relatively high coolant temperature is lower than that required due to heavy load. This will possibly cause instability of engine speed and result in engine stall.

To prevent this, according to the present invention, the reference speed is increased at a given rate within a given period of time from starting the engine. In practice, a predetermined correcting rate for reference engine speed and maintaining period of time corresponding to the coolant temperature are stored in a ROM of the memory unit 104 of FIG. 1, as a table data. Upon starting the engine, for example when turning of the starter switch ON is detected, the table data is looked up to determine the correction rate for the reference engine speed.

It should be noted that the rate for increasing the reference engine speed and period for maintaining the increased reference engine speed can be calculated with a formula corresponding to required engine operation at starting. However, the formula is quite complicate so as not to exactly follow the varying of engine condition and not to fulfill engine starting requirements completely.

Figure 4:
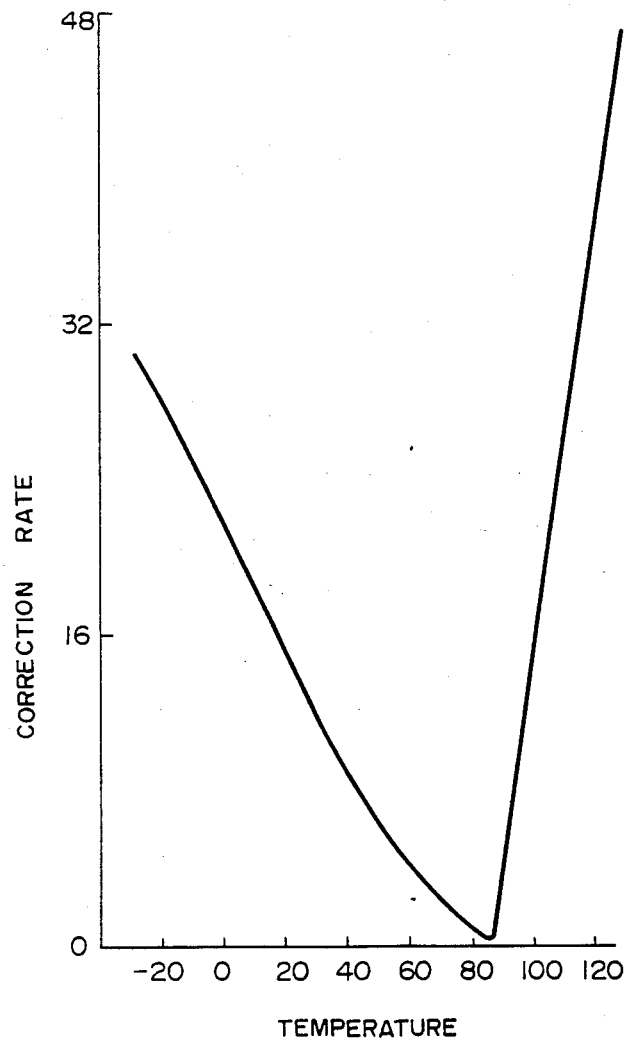
FIG. 4 is a graph showing characteristics of initial values of correction rate responsive to engine starting.

It will be also possible to determine only the first correction value for increasing the reference engine speed responsive to engine start; the correction value is determined according to the control characteristics, as shown in FIG. 4. According to this method, the first correction rate will be determined corresponding to the coolant temperature upon engine starting. After starting the engine and therefore after once determining the correction rate, the correction rate is decreased at a given rate and at a given timing.

According to this method, it is possible to make correction of the reference engine speed within a period of time proportional to the determined correction rate. This can reduce the capacity of the ROM to be used for correction upon the engine starting.

It will be appreciated that, since the fuel control system should correct the fuel supply amount upon engine starting, it is posible to use the correction value determined as above-mentioned in common.

Thus, even if the vehicle is driven under cold engine conditions and thereafter enters into idling, the engine speed can be acurately controlled. Further, upon engine starting, the engine speed is kept stable by correction of the control ratio corresponding to difference of engine load. This results in improves drivability and reduced pollution caused by engine exhaust gas.

The control ratio upon engine starting, determined as above, is corrected corresponding to kind of transmission, i.e., manual type or automatic type, transmission gear position, i.e., either drive or neutral, and air conditioner operating position. At the same time, the minimum rate of the control ratio is also determined. The following table shows correction ratios of the control ratio and the minimum duty cycle with respect to various engine conditions.

TABLE

| | Air Conditioner | Transmission Position | Correction Value (%) | Minimum Duty Cycle (%) |
|---|---|---|---|---|
| Manual | OFF | | 0 | 25 |
| Transmission | ON | | 5 | 30 |
| Automatic | OFF | Neutral | 0 | 25 |
| Transmission | OFF | Drive | 1.5 | 25 |
| | ON | Neutral | 9 | 32.5 |
| | ON | Drive | 10.5 | 34 |

As observed in the above TABLE, when the air conditioner is turned off and the transmission is in neutral range, corresponding to both the manual and automatic transmission, the correction ratio and minimum rate are the same. In the other cases, the correction ratio and the minimum rate are varied corresponding to each combination of operating conditions to acurately control the engine speed as required. By determining the minimum rate, irregular revolution of engine and instability of engine speed are satisfactorily prevented.

Figure 5:
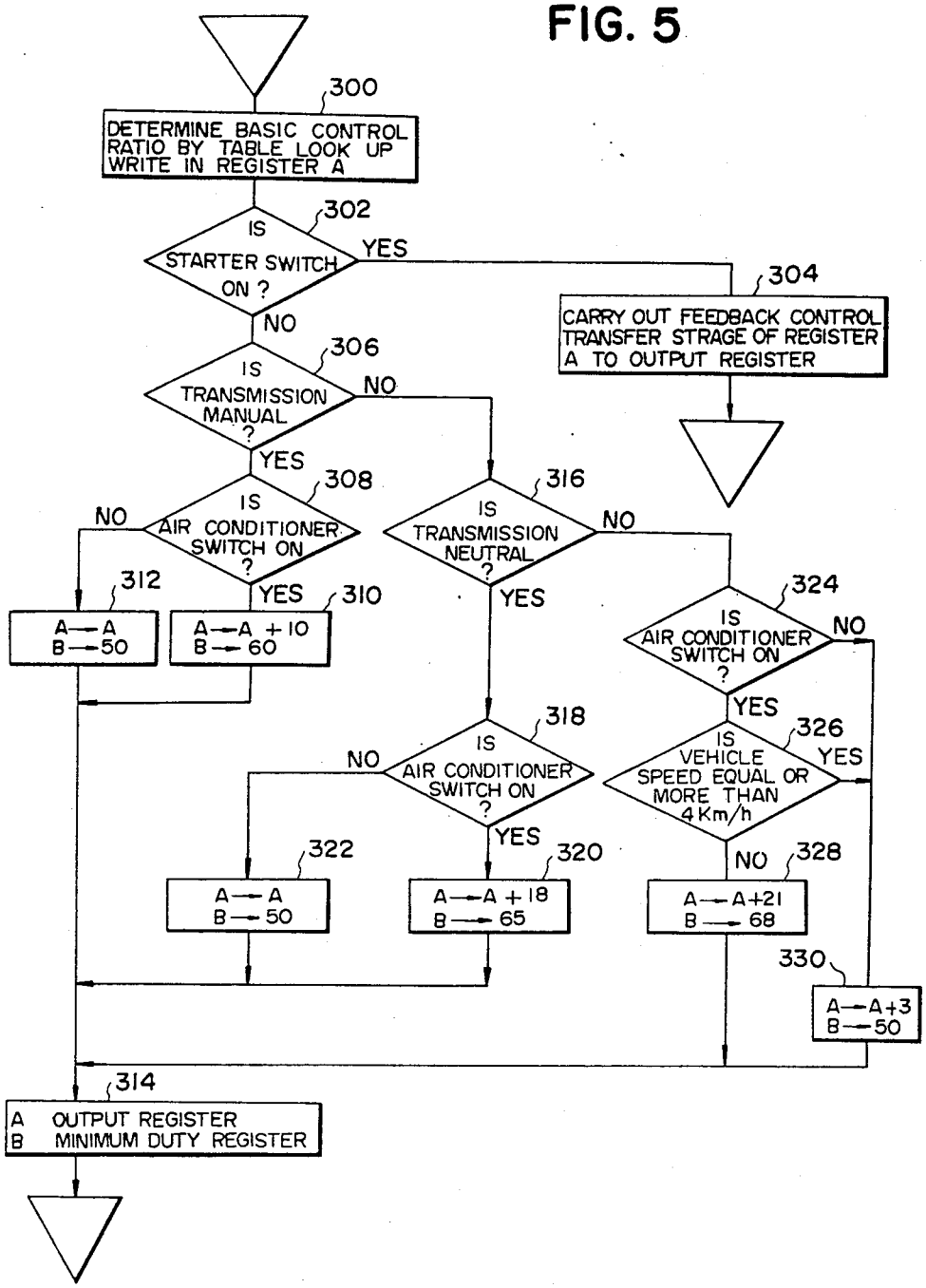
FIG. 5 is a flowchart of a program for correcting the control signal corresponding to difference of engine load conditions.

FIG. 5 shows a flowchart of a program for processing the above mentioned correction for starting engine. It should be noted the program will be executed once each cycle of engine revolution. Further, it should be appreciated that this program is executed in sequence to the program for determining the basic reference engine speed. The basic control ratio for open loop control corresponding to reference engine speed $N_{SET}$ is determined corresponding to the coolant temperature by way of table look up at a block 300. At the block 300, the determined basic control ratio is written in an register A. Thereafter, the start switch position is checked at a decision block 302. If the start switch is on, a feedback flag is set so as to carry out feedback control immediately after starting the engine, at a block 304. At the block 304, the basic control ratio stored in the register A is transferred to an output register. When the start switch is off, the kind of the transmission is checked at a decision block 306. When the transmission is the manual type, the air conditioner switch is checked at a decision block 308. If the air conditioner switch is on, the basic control ratio stored in the register A is incremented by 10 which corresponds to 5% of pulse duty of the pulse signal applied to the actuator 92 and stored again in the register A at a block 310. At the same time, value 60 as minimum output ratio which corresponds to 30% of pulse duty of the pulse signal is stored in a register B at the block 310. Likewise, if the air conditioner switch is turned off, the value 50 as the minimum ratio corresponding to 25% of pulse of the pulse signal is stored in the register B at a block 312. At this time, the control ratio stored in the register A is not corrected. After processing of the control ratio and determining the minimum control ratio, at the blocks 310 and 312, the control ratio is transfered to the output register at a block 314. At the block 314, the minimum control ratio stored in the register B is also transfered to a minimum control ratio register.

When a decision is made that the transmission is an automatic type, at the decision block 306, the gear position of the transmission is checked to determine whether the transmission is in neutral at a decision block 316. If the decision at the block 316 is YES, the air conditioner switch is checked at a decision block 318. When the air conditioner switch is turned on, the control ratio stored in the register A is incremented by 18 which corresponds 9% of pulse duty of the pulse signal at a block 320. At the same time, the minimum ratio is set in the register B at 65 corresponding to 32.5% of pulse duty at the block 320. If the air conditioner switch is turned off, the minimum value is set in the register B at a value 50 corresponding to 25% of pulse duty, at a block 322. At this time, the control output is not corrected.

If the decision at the block 316 is NO, the air conditioner switch is checked at a decision block 324 to determine whether the switch is on. If the decision is YES, the vehicle speed is checked at a decision block 326 to determine whether the speed is equal to or more than 4 km/h. If the decision of the block 326 is NO, the control output is incremented by 21 corresponding to 10.5% of pulse duty, at a block 328. At the block 328, the minimum value is set in the register B at 68 corresponding to 34% of pulse duty. When the decision of the block 324 is NO or the decision of the block 326 is YES, the control output is incremented by 3 corresponding to 1.5% of pulse duty, at a block 380. At the same time, the minimum value in the register B is set to 50 corresponding to 25% of pulse duty.

After processing of blocks 320, 322, 328 or 330, the control output is transfered to the outpaut register and the minimum value is transfered to the minimum duty register, at the block 314.

As will be appreciated, the decision block 326 is provided for restricting increasing of pulse duty of the control signal, since when the vehicle speed is relatively high, the engine speed becomes correspondingly higher than that which would possibly cause engine stall or would be required for driving or operating air conditioner. However, the block 326 is not always necessary for determining duty cycle of the control pulses for controlling idle engine speed at starting. Even if the block 326 is omitted, it will merely cause slight discomfort due to dhange of engine load corresponding to switching on and off of the air conditioner.

According to the above-mentioned program, the control ratio in open loop control accurately and satisfactorily corresponds to engine load conditions to make it easy to switch control operation thereafter. Further, by determining the minimum pulse duty corresponding to the engine load condition, even when the engine speed is rapidly decreased, the excessive duty cycle of the the pulse signal will not be applied to the valve means, and thereby, the engine can be prevented from stalling.

It will be appreciated that, according to the present invention, the control ratio may not be changed corresponding to gear position in case of a manual transmission. On the other hand, in case of an automatic transmission, the control ratio is varied corresponding to drive or neutral gear positions thereof, since the engine load is varied corresponding thereto.

While, however the specific construction are disclosed hereabove for illustration of the present invention, it will be possible to make various modifications to various features or elements consisting of the present invention. Therefore, the present invention should not be limited to the specific embodiment of the present invention and should be understood to include any modifications without departing from the principle of the present invention.

What is claimed is:

1. An intake air flow rate control system for an automotive vehicle internal combustion engine which selectively carries out either feedback control or open loop control depending upon engine operating conditions and wherein smooth transition between open loop control and feedback control of intake flow rate is effected, said system including an auxiliary air control valve with an electromagnetically operable actuator which is operated in response to a variable duty cycle control signal applied thereto to control the ratio of the energized and deenergized periods of said actuator corresponding to duty cycle of said control signal;

wherein said system comprises:

sensor means for measuring engine temperature and in response generating a sensor signal representative of the measured engine temperature;

means for measuring engine load and for generating an engine load signal in response thereto;

first means for detecting engine driving conditions and for which open loop control of intake air flow rate is required;

second means responsive to said sensor signal for determining an initial open loop control value of said auxiliary air control valve and generating said control signal to be applied to said actuator means, said variable duty cycle control signal having a duty cycle defined by said control value and defining the ratio of the energized period and the deenergized period of said actuator;

third means for generating repetitively a predetermined correction value as a function of said engine load signal to correct said initial open loop control value to thereby adjust said duty cycle of said control signal to provide a smooth transition between open loop control and feedback control; and fourth means for correcting said initial open loop control value with said correction value to produce a corrected open loop control value to control said actuator.

2. A control system as set forth in claim 1, wherein said vehicle has one of an automatic or manual transmission and has an air conditioner unit, said engine load signal being determined based upon at least one of the following; the kind of transmission, the gear position of the transmission and the air conditioner unit being on or off.

3. A control system as set forth in claim 2, wherein the correction value for correcting said duty cycle of said control signal is different depending on different factors for determining said engine load signal.

4. A control system as set forth in claim 1, wherein said system further comprises fourth means for determining a minimum open loop control value, said minimum value determined according to said engine load signal.

5. In an air induction system of an internal combustion engine of a type wherein auxiliary air flow rate is selectively open loop and feedback controlled, a method of controlling a duty cycle responsive auxiliary air control valve as a function of engine operating conditions, comprising the steps of:

determining engine coolant temperature;

determining an initial open loop control value of an auxiliary air induction rate based on the determined engine coolant temperature;

generating repetitively a predetermined correction value as a function of at least one engine operating condition for correcting said basic control value at a predetermined rate;

correcting said initial control value with said correction value to obtain a corrected control value to provide a smooth transition between open loop and feedback control;

producing a pulse signal having a duty cycle indicative of the corrected control value; and applying said pulse signal to said auxiliary air control value to control the energized and deenergized periods of said actuator.

6. A method as set forth in claim 5, wherein the engine has a starter switch and said step of determining a correction is effected in response to turning on of said starter switch.

7. A method as set forth in claim 5, wherein said correction value is varied according to an on or off condition of an air conditioner, which correction value is increased when the air conditioner is on.

8. A method as set forth in claim 5, wherein said correction value is varied depending on the kind of transmission, either manual or automatic.

9. A method as set forth in claim 5, wherein said correction value is determined based on a kind of transmission, ie., manual or automatic, gear position of the transmission and an air conditioner switch position, and which method further includes a step of defining a minimum value of the control value determined based on the kind of transmission, transmission gear position and air conditioner switch position.

10. In an air induction system of an internal combustion engine of a type wherein auxiliary air flow rate is selectively open loop and feedback controlled, a method of controlling a duty cycle responsive auxiliary air control valve as a function of engine operating conditions, comprising the steps of:

determining engine coolant temperature;

determining engine speed;

determining a reference engine speed based on the determined engine coolant temperature;

determining an initial open loop control value which is a function of a first variable based on a difference between the determined engine speed and the reference engine speed and on a second variable based on the engine coolant temperature;

correcting repetitively said initial open loop control value to a predetermined corrected open loop control value in response to engine cranking to provide a smooth transition between open loop and feedback control upon engine cranking and producing a pulse signal having a duty cycle ratio corresponding to the corrected open loop control value; and controlling said auxiliary air control valve during open loop control in response to the pulse signal.

11. In an air induction system of an internal combustion engine of a type wherein auxiliary air flow rate is selectively open loop and feedback controlled, a method of controlling an auxiliary air control valve in response to engine operating conditions, comprising the steps of:

determining engine coolant temperature;

detecting an engine operating condition and distinguishing whether the engine operating condition is appropriate for carrying out open loop control of the auxiliary air flow rate;

determining an initial auxiliary air flow rate utilizing predetermined auxiliary air flow rates depending on engine coolant temperature during open loop control;

generating repetitively a predetermined correction rate for the initial auxiliary air flow rate as a function of a load condition of the engine;

correcting the initial auxiliary air flow rate with the correction rate to produce a corrected auxiliary air flow rate to provide a smooth transition between open loop and feedback control;

producing a pulse signal having a duty cycle representative of the corrected auxiliary air flow rates; and applying the pulse signal to control the auxiliary air control valve during open loop control so that the auxiliary air introduced through said auxiliary air control valve corresponds to the initial and corrected flow rates.

12. A method as set forth in claim 11, wherein said correction rate is determined based on a kind of transmission, i.e., manual or automatic gear position of the transmission and an air conditioner switch position, and which method further includes a step of defining a minimum rate of the control rate based on the kind of transmission, manual or automatic, transmission gear position and an air conditioner switch position.

13. A method as set forth in claim 11, wherein said correction value is varied depending on the kind of transmission, either manual or automatic.

14. A method as set forth in claim 11, wherein said correction valve is varied according to the switch position of an air conditioner, which correction rate is increased when the air conditioner is on.

* * * * *